US005610377A

United States Patent [19]

Lütte

[11] Patent Number: 5,610,377

[45] Date of Patent: Mar. 11, 1997

[54] ELECTRIC SWITCH

[75] Inventor: Winfried Lütte, Climbach, France

[73] Assignees: Doduco GmbH+Co.; Eugen Durrwachter, Pforzheim, Germany

[21] Appl. No.: 232,279

[22] PCT Filed: Nov. 5, 1992

[86] PCT No.: PCT/EP92/02534

§ 371 Date: May 6, 1994

§ 102(e) Date: May 6, 1994

[87] PCT Pub. No.: WO93/09554

PCT Pub. Date: May 13, 1993

[30] Foreign Application Priority Data

Nov. 7, 1991 [DE] Germany ..... 41 36 576.3

[51] Int. Cl.[6] ..... H01H 9/28

[52] U.S. Cl. ..... 200/50.19; 200/43.04; 200/6 C; 200/52 R; 200/335

[58] Field of Search ..... 200/4, 5 R, 6 R, 200/7, 11 R, 6 A, 6 B, 6 BB, 6 C, 16 R, 16 A, 16 C, 16 D, 17 R, 18, 43.01, 43.04, 43.08, 43.11, 43.16, 43.22, 52 R, 523, 526, 529, 538, 540, 553, 558, 559, 318, 318.1, 318.2, 321, 322, 323, 327, 329, 332, 335, 333, 339, 50.01–50.2

[56] References Cited

U.S. PATENT DOCUMENTS

| | | | |
|---|---|---|---|
| 4,185,178 | 1/1980 | Drees | 200/42 T |
| 4,359,611 | 11/1982 | Haskins | 200/1 TK |
| 4,575,592 | 3/1986 | Rose | 200/6 R |
| 5,196,657 | 3/1993 | Jensen | 200/6 R |

FOREIGN PATENT DOCUMENTS

| | | | |
|---|---|---|---|
| 1465724 | 9/1969 | Germany | H01H 15/00 |
| 1765235 | 7/1971 | Germany . | |
| 3910717 | 10/1990 | Germany | H01H 1/26 |
| 3941100 | 6/1991 | Germany | H01H 9/02 |
| 2231725 | 11/1990 | United Kingdom | H01H 21/00 |
| 2236380 | 4/1991 | United Kingdom | G05G 1/00 |

*Primary Examiner*—Patrick J. Stanzione
*Assistant Examiner*—Michael A. Friedhofer
*Attorney, Agent, or Firm*—Dvorak and Traub

[57] ABSTRACT

An electric microswitch includes a base and a cap. The base has a bottom pair of terminals downwardly extending that are hermetically sealed because they are integrally formed as part of the base, while the same terminals extend upwardly from the top of the base, and are in the form of spring contacts. The housing has a pair of apertured extensions that receive a pair of pins located on the housing. The cap includes internal stops that push the spring contacts together when the cap is acted upon while in a pivotable position so that contact pieces on the springs complete the circuit. When the housing is in a non-movable position, the spring contacts and contact pieces are hermetically sealed by the housing acting against a shoulder on the base.

8 Claims, 3 Drawing Sheets

ELECTRIC SWITCH

BACKGROUND OF THE INVENTION

This invention relates to a microswitch having the features recited in the prior art part of claim 1. The basic design of such switch has been described in two variants in "Luegers" Lexikon der Technik, Vol. 14 (1969) on pages 115, 116.

In the known switch a touch pin can be actuated so that a switching fork, which in its position of rest contacts a stationary contact, is moved toward an opposite stationary contact and is urged against the latter. Upon a decrease of the actuating force exerted on the touch pin, the switching fork jumps back to its initial position. In the second variant the switch is changed over by an overcenter spring when its dead center has been overcome. The switching mechanism for both embodiments of the microswitch is disposed in a housing, from which the terminals connected to the contacts protrude and into which the touch pin extends. During the soldering of the terminals, soldering fumes may enter the switch housing at least along the touch pin and may adversely affect the switching system.

A known switch, such as U.S. Pat. No. 4,565,592, comprises a base, which has a cylindrical aperture with an opening which is parallel to the axis of the cylinder. A substantially cylindrical cap has been inserted into the aperture and has a radial extension, which extends out of the aperture. The cap is open toward the base and receives the contact springs of the switch and can be rotated to deflect said contact springs. Particularly because the base and cap must be movable relative to each other there are gaps between the base and cap and soldering fumes and moisture may enter through said gaps.

The invention avoids the obvious attempt to seal in a conventional microswitch the passage in which the touch pin is guided. Instead, it is contemplated to use a switch housing which consists of a base and a cap, which is adapted to be closed by the base. Terminals provided on the base extend out through and are sealed to the base.

The switch can conveniently be handled in a position for use, which is provided in that the cap is pulled from the base out of the closed position. The switch can be actuated in a simple manner in position for use in that the cap is deflected to one side or the other and carries along the contact spring, which protrudes into the cap and is to be actuated, until the spring makes contact. For this reason the cap is not only a means which cooperates with the base to enclose the contact springs on all sides and to hermetically seal them but is also a means for actuating the switch in a very simple manner because the pivoted cap can directly act on the contact spring which is to be deflected without a need for any transmitting members which comprise levers and articulated joints such as are otherwise conventional in microswitches and co-determine and limit their life. In contrast, owing to its simple mechanical structure the switch in accordance with the invention affords considerable advantages as regards life and can be manufactured at lower cost. Besides, the cap does not need to be fixedly connected to the base; because the cap is inherently adjustable between a closed position, in which the cap is not pivotally movable, and a position for use, in which the cap is pivotally movable, the cap can be entirely pulled from the case so that it may be a loose part. This results in the advantage that different bases optionally provided with different sets of contact springs and different caps may be combined for different applications and for installation in different positions so that a family of switches can be provided by a modular system with a minimum expenditure.

In position for use the cap can be pivotally moved, on principle, in both directions and may then deflect one contact spring and the other so that the switch is more versatile in use than known microswitches. Alternatively the switch may optionally be designed to be actuated only in that the cap is pivotally moved in only one direction.

To ensure that the cap can easily be deflected defined manner for the function of the switch, the cap pivoted on two pins, which are mounted on the base.

To provide two clicked-in positions for the cap, it desirably carries at its open end two mutually opposite extensions. Said extensions are so designed that each of them is formed with an aperture for receiving the associated pin and in the aperture are formed with a waist, by which the aperture is divided and which can be overcome in that the extensions are elastically expanded so that the cap can snap on one side of the waist to its closed position and on the other side of the constriction to its position for use and cannot incidentally move from one position to the other.

The apertures in the extensions may consist of a slot having a waist or of an indentation having a waist. In that case it will be necessary to provide at the beginning of the indentation a constriction, which is similar to the waist restrains the cap in its clicked-in position.

The switch is particularly simple in its design and function and is nevertheless versatile. It permits different contact arrangements without a departure from its basic design. For instance, both contacts of a switch may be mounted on contact springs and said contact springs can be actuated as desired by a pivotal movement of the housing. On the other hand, the countercontact for a contact piece provided on a contact spring may consist of a stationary (fixed) contact, which may be indirectly secured to the base or directly to the inside surface of the cap and the lead connected to said fixed contact may extend out through the cap. The switch may be designed as a break switch and as a make switch.

There is also a simple possibility to provide the switch as a change-over switch by the provision of a further contact spring. In that case a third contact spring is provided between two contact springs and will be contacted by one contact spring or the other upon a pivotal movement of the cap.

To minimize the angular movement (actuating movement) to be performed by the cap, it will be desirable to provide in the cap a stop for the contact spring that is to be deflected. That stop is preferably so arranged that in the open switch the contact spring concerned contacts the stop only under a slight bias, if any. The stop is preferably adjustable, e.g., because it consists of an electrically insulating adjusting screw, which extends in a tapped bore of the cap and is accessible from the outside.

The contact springs usually carry elongate profiled contact pieces, which are provided in a crosswise arrangement and welded to the contact springs, and the base and the stops consist of an insulating material.

An illustrative embodiment of the invention is shown on the accompanying drawings.

BRIEF DESCRIPTION OF THE DRAWINGS

FIG. 6 is a view like. FIG. 4 showing a modified switch.

Figure 1:
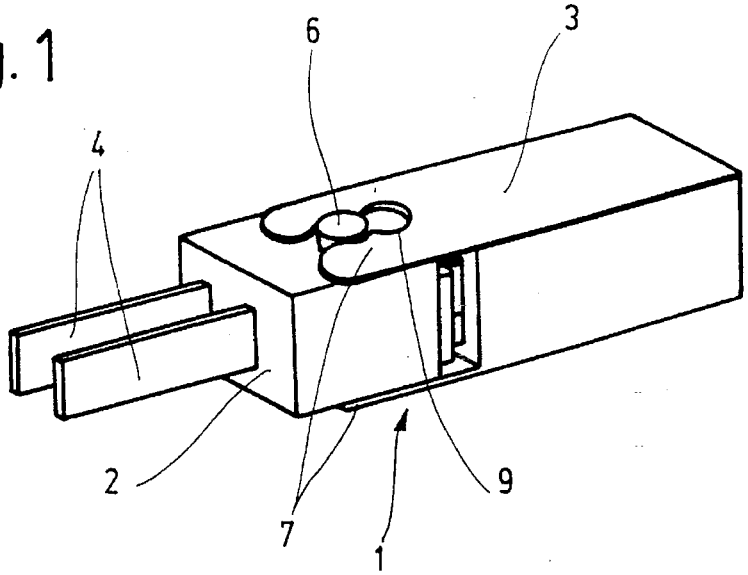
FIG. 1 is a perspective view showing a switch position for use.

An illustrative embodiment of the switch is shown on the accompanying drawing and will be described hereinafter.

The illustrated switch is an air break switch. Its housing 1 consists of a base 2 and a cap 3, which can be closed by the base 2. The base 2 carries two pins 6 for receiving the cap 3, which is opposite to the base 2, and carries a shoulder 14 for sealing the cap 3 in its closed position. The terminals 4 of two contact springs extend out through and are sealed to the base 2. The contact springs 5 and 10 extend from the base 2 into the opposed cap 3.

DETAILED DESCRIPTION OF THE PREFERRED EMBODIMENT

The cap 3 is adapted to be slidably fitted on the base 2 and at its open end carries two mutually opposite extensions 7. For receiving the pins 6, each extension 7 has an aperture 8. The apertures 8 are divided by a waist 9. The waist is so arranged that there are two clicked-in positions for receiving the pins 6.

Figure 2:
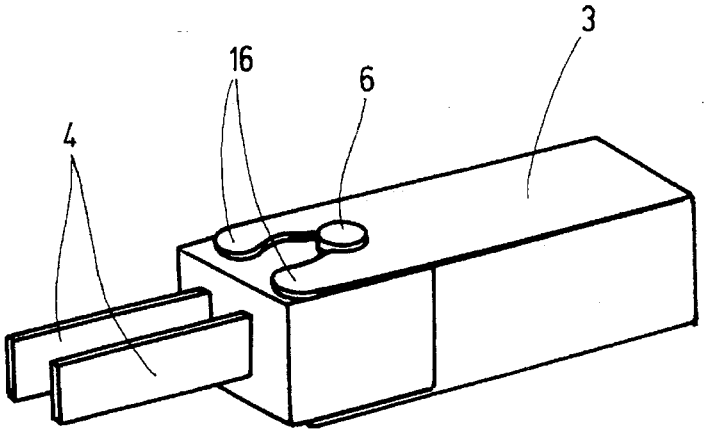
FIG. 2 is a perspective view showing the switch in its closed position.
Figure 3:
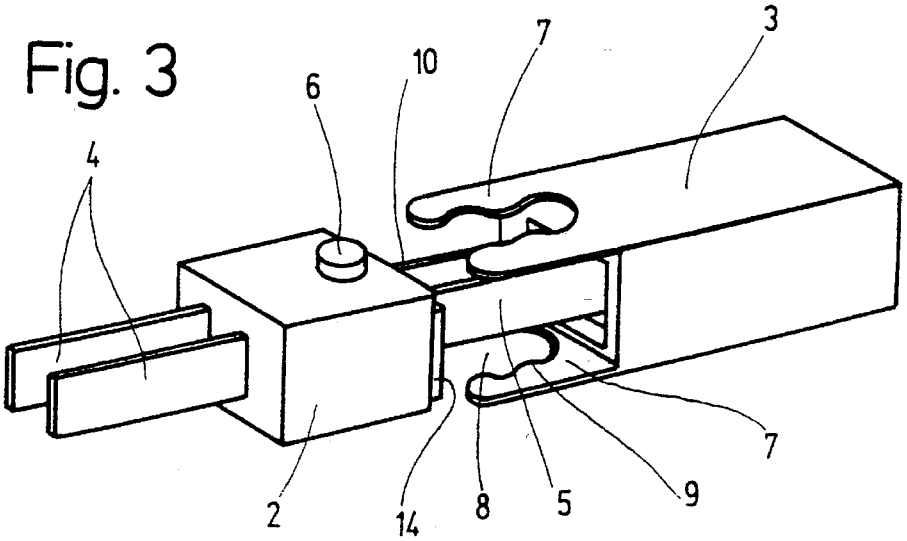
FIG. 3 is a perspective view showing the switch when the cap has been pulled off.

At the rounded ends 16 of the mutually opposite extensions 7 the width of the aperture 8 is smaller than the diameter of the pins 6 so that the extensions 7 must be elastically expanded before the cap 3 can entirely be pulled from the base 2. When the switch is open, each of the contact springs 5 and 10 protruding into the cap 3 contacts an associated stop 13, which is formed in the cap 3. The cap 3 well be in its closed position (FIGS. 2, 4 and 5) during storage and transportation and as the terminal lugs 4 of the switch are being soldered. To make the switch ready for use the cap 3 is pulled to its second clicked-in position (FIG. 1) and can now be pivotally moved to selectively urge the contact spring 5 against the contact spring or the contact spring 10 against the contact spring 5.

An expansion to provide a change-over switch can simply be effected in that a third contact spring 12 is provided between the contact springs 5 and 10. The contact springs 5 and 10 are provided with contact pieces 17, which consist of profiled wires and are provided in a crosswise arrangement.

Figure 4:
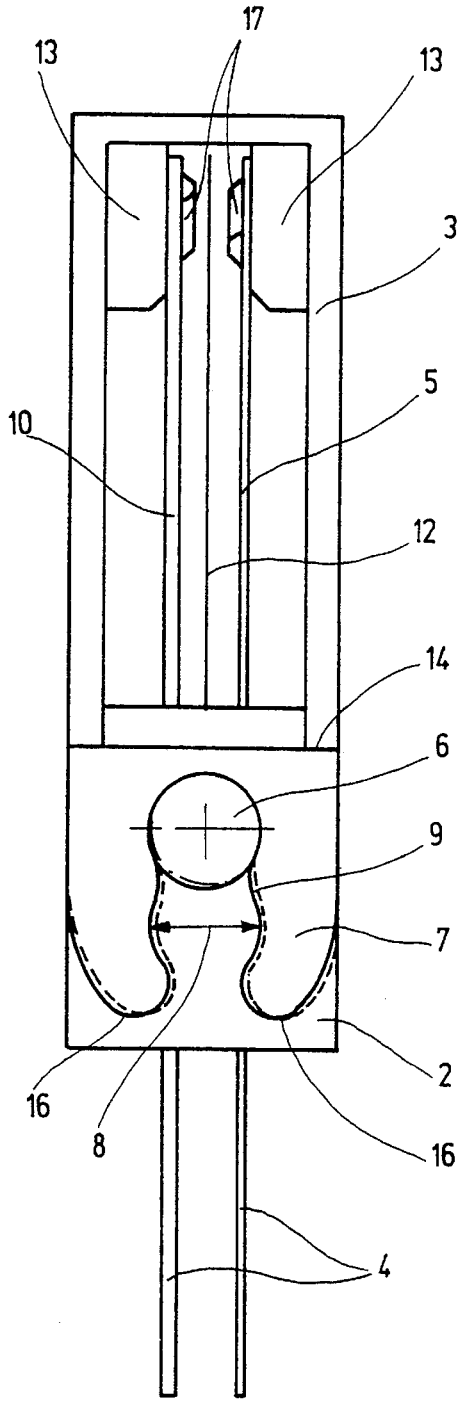
FIG. 4 is a side elevation showing the switch with the cap shown in section.
Figure 5:
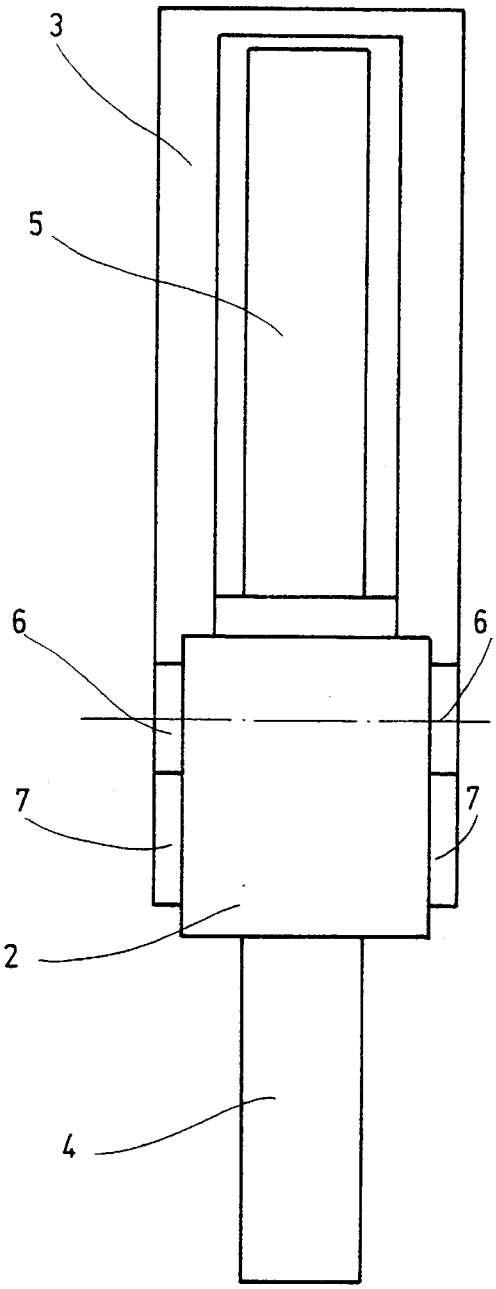
FIG. 5 is a side elevation showing the switch viewed in the direction indicated by the arrow V.
Figure 6:
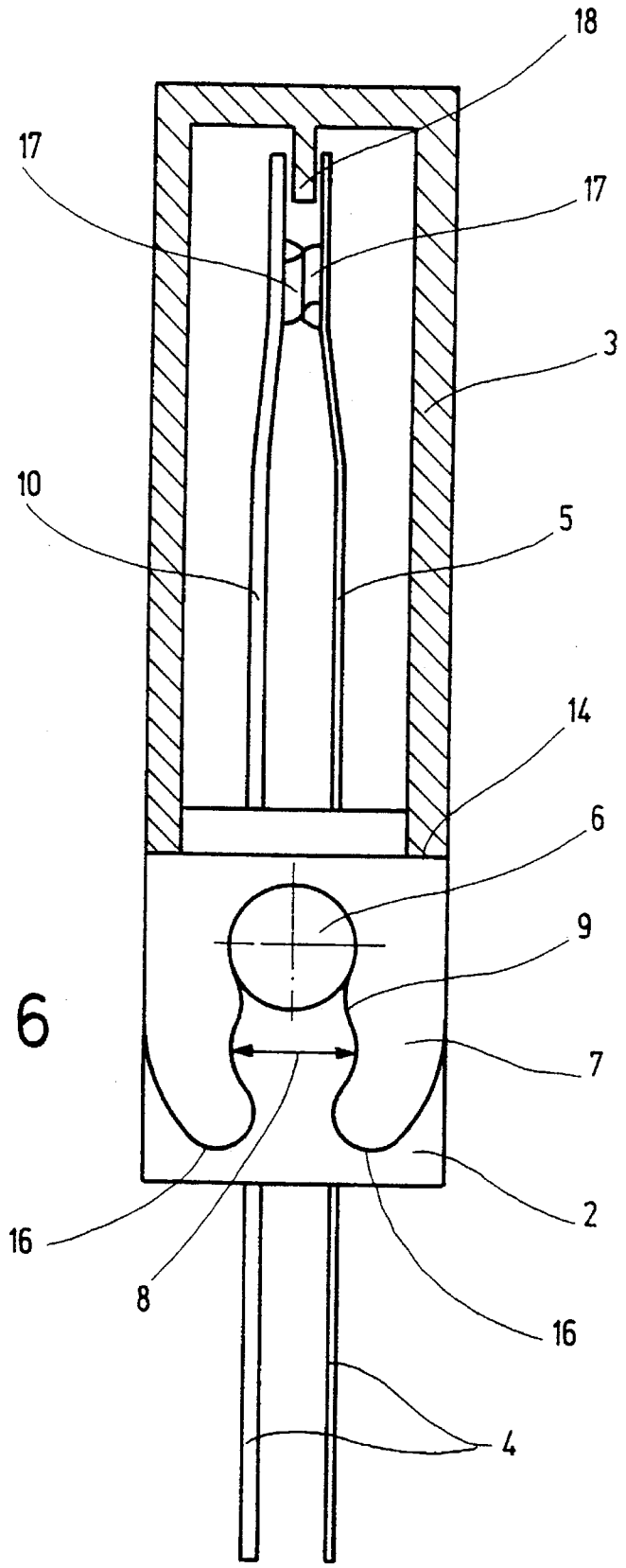

The switch shown in FIG. 4 is a make switch. FIG. 6 shows a modified switch as an opener. Like or corresponding parts are designated in FIG. 6 with the same reference characters as in FIG. 4. A difference from FIG. 4 resides in that the contact springs 5 and 10 have been bent toward each other and extend beyond the contact pieces 17. The stops 13 have been omitted and replaced by a central stop 18, which is disposed between the ends of the contact.

I claim:

1. An electric microswitch comprising:

a base having a top, a bottom, and an interconnecting side, said bottom including a pair of terminals extending downwardly therefrom and being hermetically sealed within said base, said top including a peripheral shoulder, and upwardly projecting first and second contact springs, each of said contact springs integrally formed with said terminals on said base bottom and being substantially centered within said base, each of said contact springs including a contact piece at a respective end thereof, said side of said base including a pair of opposed pins, each of said pins having a like diameter;

a hollow cap having a plurality of stops and an open end that abuttingly receives said shoulder of said base and which includes an opposed pair of elastically deformed extensions that include apertures therein for receiving said pins and attaching said cap to said base, said cap having a first position wherein said cap is held against said shoulder, and when said cap is pulled upwardly from said shoulder and out of said first position, said cap is placed in a second position wherein said cap can be manipulated in a pivotably rotatble fashion on said pins, said second position allowing one of said stops within said cap to push against and deflect one of said contact springs against the other contact spring during rotation of said cap, such that said contact pieces make contact during said movement.

2. The electric microswitch according to claim 1, wherein a third contact spring is arranged between said first and second contact springs (5 and 10) and the cap (3) deflects on of said first and second contact springs (5 and 10) as the cap (3) is pivotally moved in one direction and the other of said first and second contact springs (5 and 10) as the cap (3) is pivotally moved in the other direction.

3. The electric microswitch according to claim 1, wherein the stops (13) are adjustable.

4. The electric microswitch according to claim 1 wherein the cap (1) is a loose part and can entirely be pulled from the base (2).

5. The electric microswitch according to claim 1, where during actuation, the cap (3) is pivotally movable in two directions from a position of rest such that in one of the directions one contact spring is deflected and in the other of the directions the other of the contact springs is deflected.

6. A switch according to claim 1, characterized in that the cap (1) is a loose part and can entirely be pulled from the base (2).

7. The electric microswitch according to claim 1, wherein the cap is pivotably movable in two opposing directions such that in one direction one contact spring is deflected and in the other direction, the other contact spring is deflected.

8. The electric microswitch of claim 1 wherein each of said cap extensions has a first portion and a second portion separated from said first portion by a waist, said waist having a width that is samller than said diameter of said pins, each of said first and second portions are configured to receive said pins therein when said cap is attached to said base, said first portion receiving said pins therein so as to place said cap in said first position, and said second portion for placing said cap in said second position.

* * * * *